US006761935B2

(12) United States Patent
Sanchez et al.

(10) Patent No.: US 6,761,935 B2
(45) Date of Patent: Jul. 13, 2004

(54) METHOD AND DEVICE FOR THE PRODUCING A METALLIC COATING ON AN OBJECT EMERGING FROM A BATH OF MOLTEN METAL

(75) Inventors: Gérald Sanchez, Montigny le Bretonneaux (FR); José Delot, Chateau Landon (FR)

(73) Assignee: Delot Process, Boundoufle (FR)

( * ) Notice: Subject to any disclaimer, the term of this patent is extended or adjusted under 35 U.S.C. 154(b) by 406 days.

(21) Appl. No.: 09/818,637

(22) Filed: Mar. 28, 2001

(65) Prior Publication Data

US 2002/0007784 A1 Jan. 24, 2002

(30) Foreign Application Priority Data

Mar. 28, 2000 (FR) ..... 00 03881

(51) Int. Cl.[7] ..... B05D 1/18

(52) U.S. Cl. ..... 427/431; 427/434.2; 427/434.6; 427/436; 427/8; 427/598

(58) Field of Search ..... 427/431, 434.2, 427/434.6, 436, 8, 598, 433; 118/419, 429

(56) References Cited

U.S. PATENT DOCUMENTS

| | | | | |
|---|---|---|---|---|
| 2,914,423 A | | 11/1959 | Knapp | |
| 3,965,857 A | | 6/1976 | Baxter | |
| 4,169,426 A | | 10/1979 | Kornmann | |
| 4,228,200 A | | 10/1980 | Sander et al. | |
| 4,324,266 A | | 4/1982 | Garnier et al. | |
| 4,612,215 A | * | 9/1986 | Hennechart et al. | 427/192 |
| 5,384,166 A | * | 1/1995 | Sato et al. | 427/547 |
| 5,787,110 A | * | 7/1998 | Fishman et al. | 373/151 |
| 5,897,683 A | * | 4/1999 | Unoki et al. | 75/10.14 |

FOREIGN PATENT DOCUMENTS

| | | |
|---|---|---|
| EP | 0 720 663 B1 | 6/1997 |
| EP | 0 811 701 | 12/1997 |

OTHER PUBLICATIONS

Landau et al. *ACTA Physicochimica U.R.S.S*, "Dragging of a Liquid by a Moving Plate," vol. XVII, No. 1–2, 1942, pp. 42–54.

Malmendier. CRM (Centre de Recherches Metallurgiques), "Improvement of control of the zinc loading in the hot–dip galvanizing process pp. 407–412, May 27–29, 1997".

* cited by examiner

*Primary Examiner*—Michael Barr
(74) *Attorney, Agent, or Firm*—Young & Thompson

(57) ABSTRACT

A method of producing a metallic coating on an object emerging from a bath of molten metal. The object can for example be a wire or a plate. A magnetic field is created near the point of exit of the object. The object leaves the bath of molten metal via an exit channel containing a meniscus of the bath of molten metal. The thickness of the metallic coating is controlled as a function of the second derivative of the curve of the meniscus and of a capillary number Ca representing the ratio between the viscous forces of the molten metal and the forces of surface tension at the surface of the molten metal.

11 Claims, 3 Drawing Sheets

METHOD AND DEVICE FOR THE PRODUCING A METALLIC COATING ON AN OBJECT EMERGING FROM A BATH OF MOLTEN METAL

BACKGROUND OF THE INVENTION

The invention relates to a method of producing a metallic coating on an object emerging from a bath of molten metal. The invention also relates to a device applying the said method.

It has a particularly interesting application in the field of the manufacture of electrode wire for spark erosion. For this purpose, first a metallic coating is made, in zinc for example, on a metallic wire, of copper or steel for example, then the coated wire is placed in a heat-treatment furnace so as to obtain diffusion of the zinc into the metal wire.

It is also possible to make a coating of tin on a core of steel or of copper, and the product obtained is then intended to undergo drawing operations.

The invention can also find applications in other fields such as the production of a metallic coating for protecting a non metallic core, for example an optical fibre.

The general principle of manufacture of electrode wire for spark erosion is described extensively in the prior art, in particular in documents U.S. Pat. No. 4,169,426 and EP-A-0 811 701, in which a conducting wire passes vertically through a bath of molten metal and is then subjected to treatments for the purpose of being drawn. The complex and costly process described in document U.S. Pat. No. 4,169,426 relates to a pretreatment for cleaning metal wire before the latter passes through the bath of molten metal and undergoes rapid cooling. Document EP-A-0 811 701 describes two electrodes in contact with the metal wire, respectively upstream and downstream from the bath of molten metal, so that the part of the metal wire between the two electrodes is heated by the Joule effect, by passing a current through these electrodes.

One of the principal characteristics in the production of a coating is the thickness of the outer layer obtained. Theoretical results relating coating thickness to the speed of travel of the metal wire and to the hydrodynamic properties of the molten metal were established in particular by L. Landau and B. Levich in an article in Acta Physicochimica U.R.S.S. Vol. XVII, No. 1–2, 1942: "Dragging of a Liquid by a Moving Plate". This article gives an equation relating, in first order, the coating thickness—which is assumed constant—to a capillary number that is a function of the hydrodynamic properties of the molten metal, provided that the molten metal is a liquid that wets perfectly and the object being coated is a plate.

Now, on the basis of the aforementioned theoretical results, the thickness obtained is often too great for coating applications in which a fine thickness is desired. Accordingly, various forms of wiping, i.e. of reducing the thickness of the coating formed, have been proposed, such as techniques of pneumatic wiping (action of air knives forming a back-pressure on the free surface of the metallurgical product emerging from the liquid bath), techniques of mechanical wiping (action of rollers that "lick" the metallurgical product by means of asbestos pads) and finally, techniques of magnetic wiping, the present invention belonging to this last-mentioned category.

The magnetic wiping techniques make use of the Lorentz forces that are generated in the coating liquid by a magnetic field, static or alternating, fixed or sliding. The action of a magnetic field on a liquid metal is known and is described in particular in document U.S. Pat. No. 4,324,266. This document discloses a device for accomplishing the confinement of a jet of liquid metal by creating an overpressure by means of a coil encircling the jet and carrying an alternating current whose frequency is below a given value. In general, many techniques of magnetic wiping are included in the state of the art, in particular patent EP 0 720 663 B1 of the present applicant, in which an inductor, arranged around an exit channel of the bath of molten metal, produces a transverse, alternating electromagnetic field of quite low frequency, and sliding, the movement of the galvanized product taking place along a horizontal axis. The device thus embodied makes it possible to determine the conditions for which the Couette lengths associated with the flow of the coating liquid respectively in the container and in its exit channel remain below critical values, above which the flows become decidedly turbulent. These conditions require accurate dimensioning in the vessel containing the liquid metal and make it possible, in the case of horizontal drainage, to keep the molten metal inside the exit channel. The thickness is controlled according to a formula similar to that employed in the hydrodynamic model of Landau and Levich, the references for which were cited above. However, the method described in this document EP 0 720 663 B1 cannot relate to products of small thickness, as the design of the inductor means that its air gap is too large for the sliding field created by the said inductor to be able to act effectively on the said products.

Document U.S. Pat. No. 4,228,200 describes a method of controlling the metallic coating on a wire emerging vertically from a bath of molten metal. The thickness is controlled by means of a single-coil device creating a fixed, alternating electromagnetic field of very low frequency, applied at the point of exit or below the point of exit of the wire. The electromagnetic field thus created expels the molten metal from the zone of highest flux density towards zones with a lower flux density. Coating thickness is adjusted by altering the amplitude of the electromagnetic forces exerted by the field generated by the electromagnetic device. However, as can be seen in FIGS. 3A and 3B of document U.S. Pat. No. 4,228,200, the device saturates for a frequency above 300 Hz for example. The magnetic field created no longer exerts an influence on the thickness of the coating. In addition, this saturation must be strongly dependent on the type of metal used, since each metal has a different saturation level.

There is a known method of magnetic wiping, developed by M. Malmendier, J-F. Noville and S. Wilmotte of the Metallurgical Research Centre (Centre de Recherches Métallurgiques, CRM) of Liege, and disclosed in the "Conference Proceedings" with the title "Improvement of control of the zinc loading in the hot-dip galvanizing process", pages 407–412, 27–29 May 1997. This method employs a magnetic field created by means of an alternating current, acting on the thickness of the coating already formed. However, the said method requires the use of high power, and involves an excessive temperature rise of the coating.

SUMMARY OF THE INVENTION

The present invention aims to remedy the aforementioned drawbacks and relates to a method of making a coating in which the coating thickness is controlled accurately, by taking into account all of the parameters involved in the production of the said coating.

Another object of the invention is the production of a coating of small thickness, typically of the order of a micrometer on small objects, with low energy consumption and limiting the temperature rise of the coating.

Yet another object of the present invention is a device in which the vessel containing the bath of molten metal is suitably dimensioned so as to permit efficient control of coating thickness regardless of the type of drainage of the object (vertical, slanting or horizontal).

The aforementioned aims are achieved with a method of producing a metallic coating on an object emerging from a bath of molten metal, in which a magnetic field is created near the point of exit of the object. According to the invention, the object leaves the bath of molten metal through an exit channel containing a meniscus of the said bath of molten metal, and the thickness of the metallic coating is controlled as a function of a second derivative of the curve of the meniscus and of a capillary number Ca representing the ratio between the viscous forces of the molten metal and the forces of surface tension at the surface of the molten metal.

This characteristic can be represented in the form of an equation:

$$e_0 \cdot \varphi_{zz} = 1.3Ca^{\frac{2}{3}},$$

$e_0$ is the thickness, $\phi_{zz}$ is the second derivative of the meniscus and z is the axis of travel.

The object to be coated can advantageously be a linear product of constant cross-section such as a wire or thread, e.g. a metal wire or an optical fibre, or a plate. For a plate of small thickness, the shape of the meniscus on the large sides is taken into account.

With such a method, the invention offers an advantage relative to the documents of the prior art, as it expresses the thickness as a function of the physical elements represented in the second derivative and in the number Ca, which is explained below.

The properties of the coating, especially its thickness, result from competition between mainly four types of forces:

- the forces of gravity, proportional to ρg, where ρ is the density of the molten metal, and g is the acceleration of gravity;
- the forces of viscosity, proportional to $\mu$V, where $\mu$ is the dynamic viscosity of the molten metal, and V is the velocity, characterizing the movement of the object relative to the molten metal;
- the forces of surface tension, proportional to γ, where γ is the interfacial tension between the molten metal and the air; and
- the repulsive forces of electromagnetic origin between an inductor, through which an alternating current is passing, and the molten metal, these forces being proportional to $$\frac{C_f B_0^2}{2\mu_0},$$

where $B_0$ is the magnetic field, $\mu_0$ is the magnetic permeability of the molten metal, and $C_f$ is a coefficient such that $$C_f = 1 - \frac{1 - e^{-\sqrt{R_\omega}}}{\sqrt{R_\omega}},$$

with a screening parameter $R_\omega = \mu\sigma\omega l^2$, σ is the conductivity of the metal, ω is the angular frequency, and 1 is a dimension that is characteristic of the geometry, such as the radius "r" for a wire and the capillary length "a" for a plate.

The capillary number Ca represents the ratio between the forces of viscosity and the forces of surface tension:

$$Ca = \frac{\mu V}{\gamma}.$$

According to one embodiment of the invention, during vertical drainage upwards, the exit channel is dimensioned so as to keep the meniscus of the molten metal in conditions close to capillary-gravitational equilibrium in the magnetic field. Under these conditions, the second derivative of the curve of the said meniscus is a function of an electromagnetic forming parameter K representing the ratio between the forces of surface tension and the forces due to the effect of electromagnetic forming:

$$K = \frac{2\mu_0\gamma}{C_f B_0^2 l}.$$

In this case of vertical drainage upwards, and for a plate, the expression for the second derivative can be as follows:

$$\varphi_{zz} = \frac{1}{aK\cos^3\theta e}\sqrt{1 + 2K^2(1 - \sin\theta e)}$$

where "a" is the capillary length (known value)

$$a = \sqrt{\frac{\gamma}{pg}},$$

and θe is the acute angle at the intersection of the apex of the meniscus with the wall of the object to be coated.

In the case of a wire, the expression for the second derivative can be as follows:

$$\varphi_{zz} = \frac{Bd \cdot \lambda_2 + \frac{1}{K} - \cos\theta e}{1.3 * r * \cos^3\theta e}$$

r is the radius of the wire; $\lambda_2$ is such that $r^*\lambda_2$ is equal to the height of the meniscus $\mathbf{1}_2$, $\lambda_2$ is preferably obtained by numerical calculation; and Bd is a Bond number representing the ratio between the forces of gravity and the forces of surface tension:

$$Bd = \frac{pgr^2}{\gamma}.$$

It is thus possible for the coating thickness $e_0$ to be determined accurately.

These equations have been established in the case of vertical drainage upwards and provided we are close to capillary-gravitational equilibrium in an electromagnetic field in which the forces of gravity and of electromagnetic forming are compensated by the forces of surface tension.

The exit channel can be constructed in such a way that the annular distance is of the order of the height of the meniscus, the annular distance being the distance between the inside wall of the exit channel and the metallic coating formed outside of the meniscus. In the case of a plate, the height $l_2$ of the meniscus can be obtained from the following expression:

$$l_2 = \frac{a}{k}\left(\sqrt{1 + 2K^2(1 - \sin\theta_e)} - 1\right)$$

According to a variant of the invention, during vertical drainage downwards, the second derivative of the curve of the said meniscus is a function of:

the ratio between the average thickness of the said object and the opening of the exit channel; and the ratio between the Alfen rate and the rate of drainage of the said object.

The Alfen rate $U_A$ is given by the expression:

$$U_A = \frac{\sqrt{C_f} \cdot B_0}{\sqrt{\mu_0 \rho}}.$$

In this first variant according to the invention, an expression of the second derivative of the curve of the meniscus in the case of a wire for example can be as follows:

$$\varphi_{zz} = \frac{1}{R1}\left[2 + \left(\frac{R1}{RO}\right)^4 \cdot \left(1 + \frac{U_A^2}{\alpha V_0^2}\right)\right]$$

where R1 is the radius of the wire, R0 is the radius of the opening of the exit channel, $V_0$ is the velocity of travel of the wire, and $\alpha$ is a term reflecting the influence of the Couette flow, equal to:

$$\frac{1}{2}\left[\frac{1 - \left(\frac{R1}{R0}\right)^2}{1n\frac{1}{\left(\frac{R1}{R0}\right)}} - 2\left(\frac{R1}{R0}\right)^2\right].$$

According to one embodiment of the invention, the exit channel is constructed in such a way that the ratio between the average thickness of the said object and the opening of the exit channel is greater than or equal to 0.8 so as not to have intense fields.

In the case of a circular wire, the average thickness is the diameter. In the case of a non-circular wire, the average thickness is an estimated value.

A special feature of the present invention is that it avoids the influence of gravity. Thus, in contrast to some methods of the prior art that create a magnetic field acting in the coating layer already formed, the magnetic field according to the invention acts directly on the meniscus.

According to the invention, the magnetic field can be alternating and steady-state, and it can be created advantageously by means of a flat inductor. An inductor of the "Pancake" type can be used.

The invention is thus remarkable in that the magnetic field created only acts upon a small height of the molten metal forming the coating. Thus, the rise in temperature of the coating due to the magnetic field is advantageously small relative, for example, to the method proposed by the Metallurgical Research Centre of Liege, cited above.

Thus, for comparison, using the formulae established by the Metallurgical Research Centre, under the following conditions:

for an intended thickness of 10 $\mu$m, for a line speed of 60 m/min, in the case of complete wetting, $\theta e=0$, we obtain a magnetic field intensity B0=0.71T and a temperature rise of $\Delta T \cong 100°$ C. by the method of the Metallurgical Research Centre.

With the same conditions as above, the method according to the invention gives: B0–0.078T and $\Delta T \cong 7°$ C.

The magnetic field is preferably created by means of an alternating current whose frequency is such that the ratio between the capillary length and the magnetic skin thickness in the metallic coating is greater than or equal to 3.

According to another variant of the invention, in the case of horizontal drainage with an exit channel containing a meniscus obtained by applying a sliding field in the bath of molten metal, the second derivative of the curve of the meniscus is a function of a Bond number Bd representing the ratio between the forces of gravity and the forces of surface tension:

$$Bd = \frac{\rho g l^2}{\gamma}.$$

This second variant makes advantageous use of the teaching contained in document EP 0 720 663 B1.

According to an advantageous characteristic of the invention, means are employed for pressure or electromagnetic pumping of the molten metal to maintain the height of the meniscus in the exit channel, making it possible to compensate the continuous consumption of molten metal in production of the said coating.

The invention also relates to a device for producing a metallic coating on an object emerging from a bath of molten metal. The device includes means for creating a magnetic field near the exit point of the said object. The device can include an exit channel containing a meniscus of the said bath of molten metal, as well as means for adjusting the thickness of the metallic coating as a function of a second derivative of the curve of the meniscus and of a capillary number Ca representing the ratio between the viscous forces of the molten metal and the forces of surface tension at the surface of the molten metal.

BRIEF DESCRIPTION OF THE DRAWINGS

Other advantages and characteristics of the invention will become clear on examining the detailed description of one embodiment, which is in no way limiting, and the appended drawings in which.

DETAILED DESCRIPTION OF THE PREFERRED EMBODIMENTS

Figure 1:
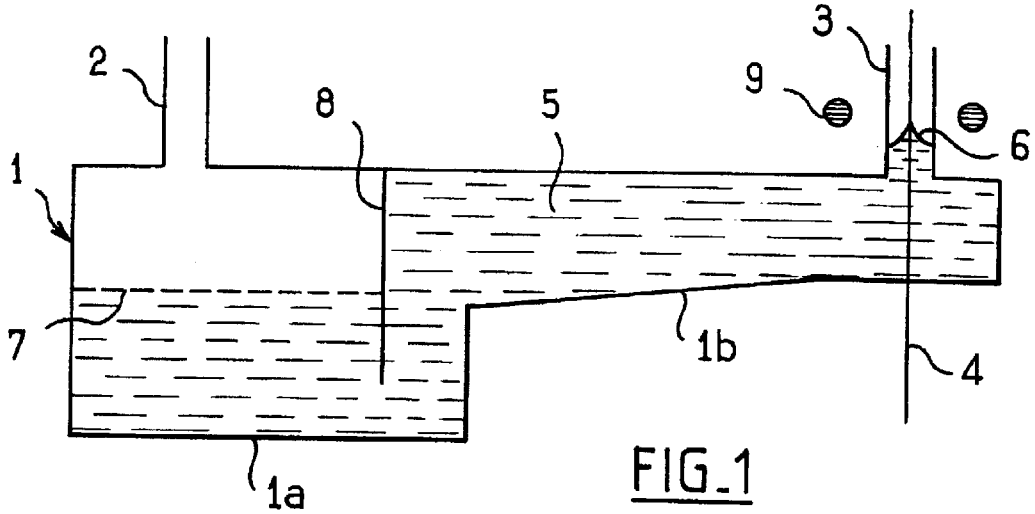
FIG. 1 is a simplified sectional view of a vessel containing a molten metal, through which a metal wire passes vertically, it being possible to displace the molten metal by means of a gas.
Figure 2:
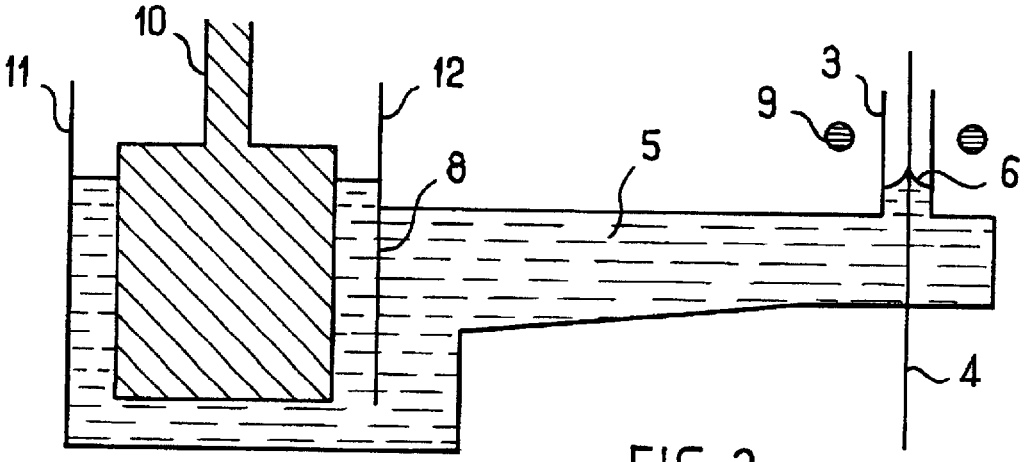
FIG. 2 is a simplified sectional view of a vessel containing a molten metal, through which a metal wire passes, it being possible to displace the molten metal by means of a piston.

Referring more particularly to FIG. 1, the device according to the invention comprises a vessel 1 made up in general of two volumes 1*a* and 1*b*, the top faces of which are aligned. The first volume 1*a*, performing the role of a reservoir, is in the shape of a rectangular parallelepiped. This reservoir 1*a* feeds, via an ascending channel, the second volume 1*b* of smaller height and of greater length relative to the dimensions of the first volume. The feed channel is constructed by means of a vertical barrier 8, with height greater than that of the second volume 1*b*, fixed to the top face of the first volume 1*a* so as to allow passage via the bottom of volume 1*a* to the second volume 1*b*.

Vessel 1 contains a molten metal 5 such as zinc or tin for example. A feed channel 2 is arranged on the upper face of the first volume 1*a* so as to exert a pressure on the surface 7 of the molten metal 5 by means of a gas injected into this feed channel 2. The pressure exerted by a gas through feed channel 2 makes it possible to drive back the molten metal from the first volume 1*a* towards the second volume 1*b* and thus compensate the loss of molten metal used for galvanizing. This galvanizing is carried out on a metal wire 4, of steel for example, positioned vertically in the second volume 1*b* near the outer edge. External means of threading (not shown) permit upward movement of the metal wire 4, which enters the second volume 1*b* via a horizontal face and re-emerges through an exit channel 3 arranged on the upper face of this volume 1*b*. The exit channel 3 is of annular shape and is so dimensioned that the molten metal enters up to a certain height, forming a meniscus 6. The metal wire 4 passes along the centre of channel 3. According to the invention, a flat inductor 9 of the "Pancake" type is arranged around channel 3 by the meniscus 6. The inductor 9 is supplied with alternating current so as to create a steady-state alternating magnetic field that exerts an influence on the molten metal at the meniscus 6. A flat inductor is used because the minimum height $\Delta z$ of molten metal at the level of the meniscus, that the magnetic field must cross in order for the electromagnetic effect created to be completed, is very small.

As an example, consider the following configuration:

$V_0$=1 m/s, where $V_0$ is the rate of travel of the metal wire;

$B_0$=0.05 T, where $B_0$ is the intensity of the magnetic field;

$\rho=7*10^3$ kg/m$^3$, where $\rho$ is the density of the molten metal;

$R_0=4.3*10^{-3}$, where $R_0$ is the internal radius of exit channel 3.

From the formula $$\Delta z = \sqrt{2} * R_0 * V_0 * \frac{\sqrt{\mu_0 \rho}}{B_0}$$

we obtain a height of approx. 11.4 mm.

As $\Delta z$ is very small, a flat inductor can be used advantageously for an alternating magnetic field. This magnetic field induces a pressure force at the level of the meniscus 6. The pressure difference between the meniscus and the air is given by the expression:

$$\Delta p = \frac{B^2}{2\mu_0} F\left(\frac{a}{\delta m}\right)$$

where "a" is the length of the capillary, $\delta m$ is the thickness of the electromagnetic skin, and F is a continuous function that tends towards zero when $a/\delta m$ tends towards zero, but tends towards 1 when $a/\delta m$ is greater than or equal to 3. Thus, for maximum effectiveness of the pressure on meniscus 6, we must have at least $$\frac{a}{\delta m} = 3,$$

and therefore F must be maximum, equal to 1.

On this basis, for zinc, for which the surface tension $\gamma$–0.75 Nm, and $\rho$=6900 kg/m$^3$, we get a =3.3 mm, i.e. $\delta m$ is close to 1 mm.

On the one hand, this means that the value of the frequency of the magnetic field can be determined advantageously, i.e. a value greater than 100 kHz.

The invention is remarkable in the sense that the temperature rise $\Delta T$ of the metal wire due to the action of the magnetic field is minimized here, and this is due in part to the fact that the heat balance applies to a very small height subjected to the magnetic field $\Delta z$.

As an example, again with the above values and using the formula:

$$\Delta T = \frac{B^2}{\mu_0 \sigma \delta_m} \frac{1}{\rho C_p} \frac{\Delta z}{R_1 V_0}$$

with electrical conductivity $\sigma=2*10^6$ $(\Omega m)^{-1}$, and heat capacity of the metal wire Cp=500 J/kgK.

A temperature rise $\Delta T$ close to 2.6°K is obtained, which is very small.

Figure 5:
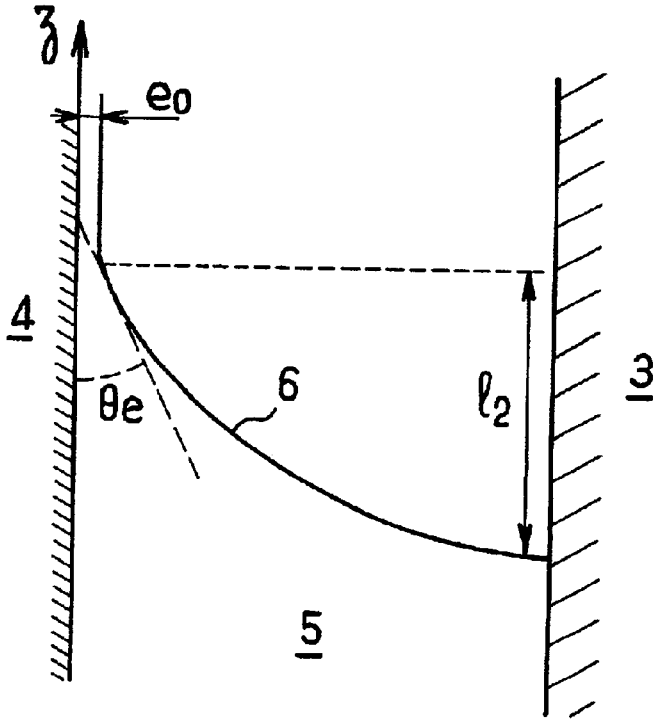
FIG. 5 is a schematic view of the meniscus in the exit channel.
Figure 6:
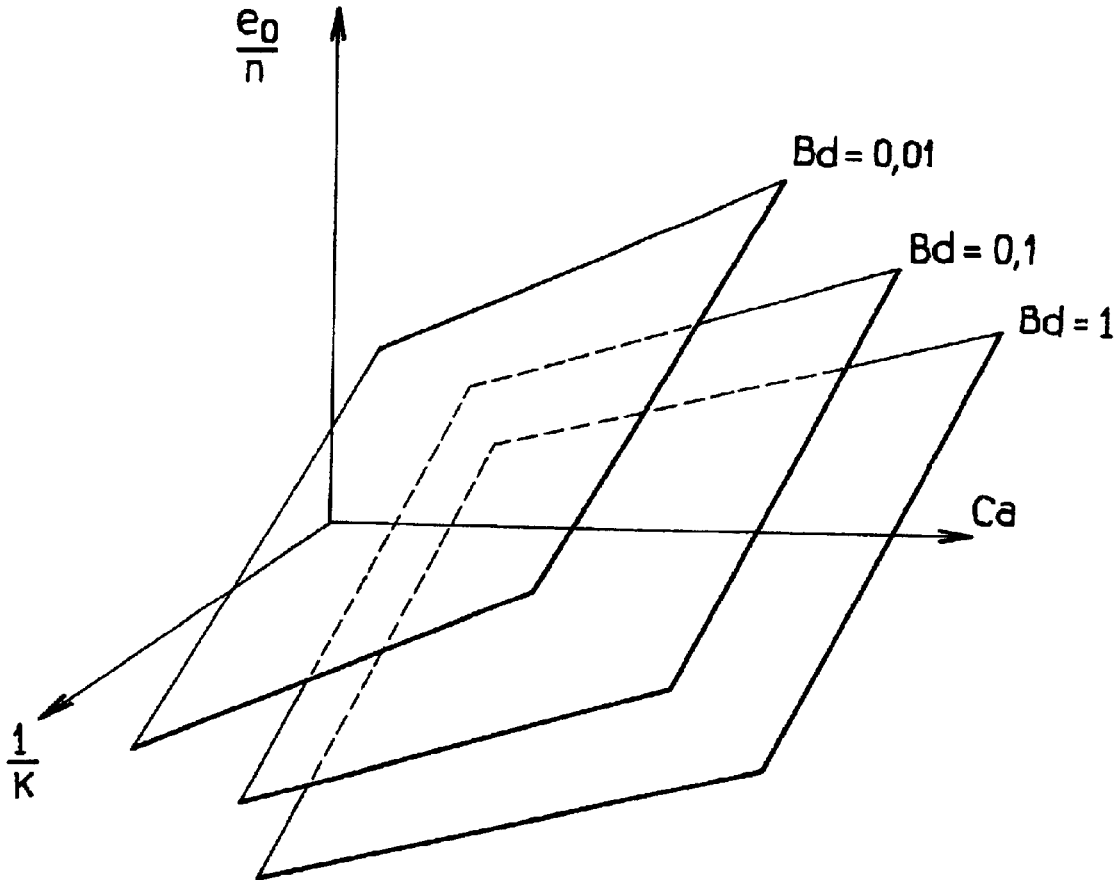
FIG. 6 is a graph showing the thickness of the coating as a function of the dimensionless numbers (Ca, Bd and K) in the form of sheets.

FIG. 5 makes it possible to visualize certain characteristic parameters at the level of the meniscus. Thus, we can distinguish the thickness $e_0$ of the coating forming an outer layer around the metal wire 4. When the meniscus 6 reaches a width of $e_0$, we define at this point an angle $\theta e$ which varies as a function of the degree of wetting by the molten metal. The height of the meniscus is given by $r\lambda_2$. From the equation for the thickness of the coating for a metal wire:

$$\frac{e_0}{r} = \frac{1.3\cos^3\theta e}{Bd \cdot \lambda_2 + \frac{1}{K} - \cos\theta e} Ca^{\frac{2}{3}},$$

it is possible to represent the thicknesses in terms of the dimensionless numbers defined above: Ca (capillary number), Bd (Bond number) and K (electromagnetic forming parameter). This curve is shown in FIG. 6 in the form of separate sheets as a function of Bd in a three-dimensional space with the coordinates 1/K, Ca and $e_0/r$. This curve can be used as a nomogram for wire coating.

To maintain the height of the meniscus and ensure that there is still molten metal in exit channel 3, an external device is provided for injecting gas into vessel 1*a* via feed channel 2 and driving the level 7 back down in relation to the quantity of molten metal consumed in production of the coating.

Maintenance of the level of meniscus 6 can also be achieved by means of a device similar to that in FIG. 1, but replacing the gas feed channel 2 by a piston 10 submerged in the molten metal 5 in vessel 1*a* flanked by vertical walls 11 and 12.

Figure 3:
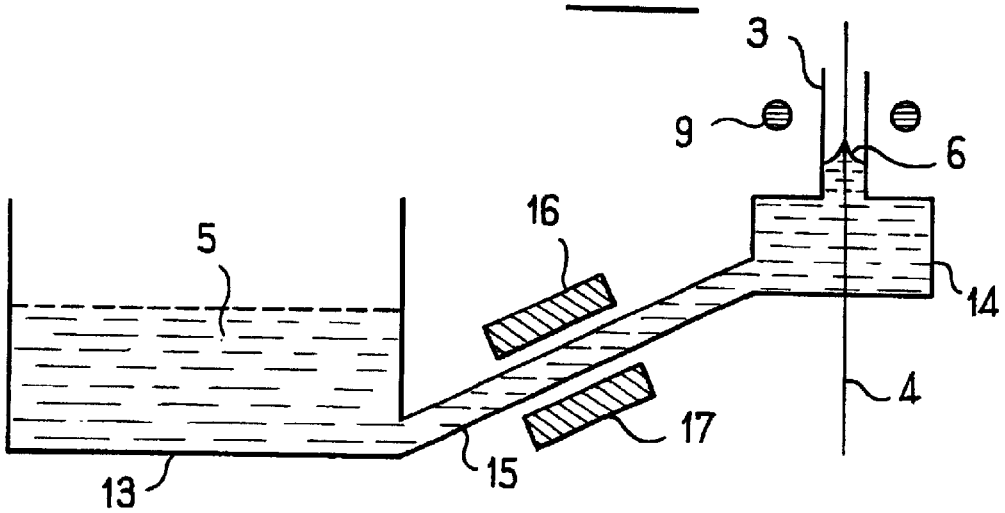
FIG. 3 is a simplified sectional view of a vessel made up of two sub-vessels, with the metal wire passing through one of them, it being possible to displace the molten metal by means of electromagnetic pumps.

Maintenance of the level of meniscus 6 can also be achieved by means of a device such as that shown in FIG. 3, in which vessel 1 has two separate compartments 13 and 14 linked simply by a channel 15 of small cross-section relative to the two compartments. Compartment 14 is positioned at a height above the bottom of compartment 13 so that the channel 15, connected to the bottom of compartment 13, slopes upwards and is connected to the bottom of compartment 14. The metal wire 4 passes through compartment 14 vertically from bottom to top, emerging via the exit channel 3 constructed on the upper face of compartment 14. To make up for the consumption of molten metal, electromagnetic pumps 16 and 17 have been fitted on either side of channel 15 for pumping the molten metal towards compartment 14.

Figure 4:
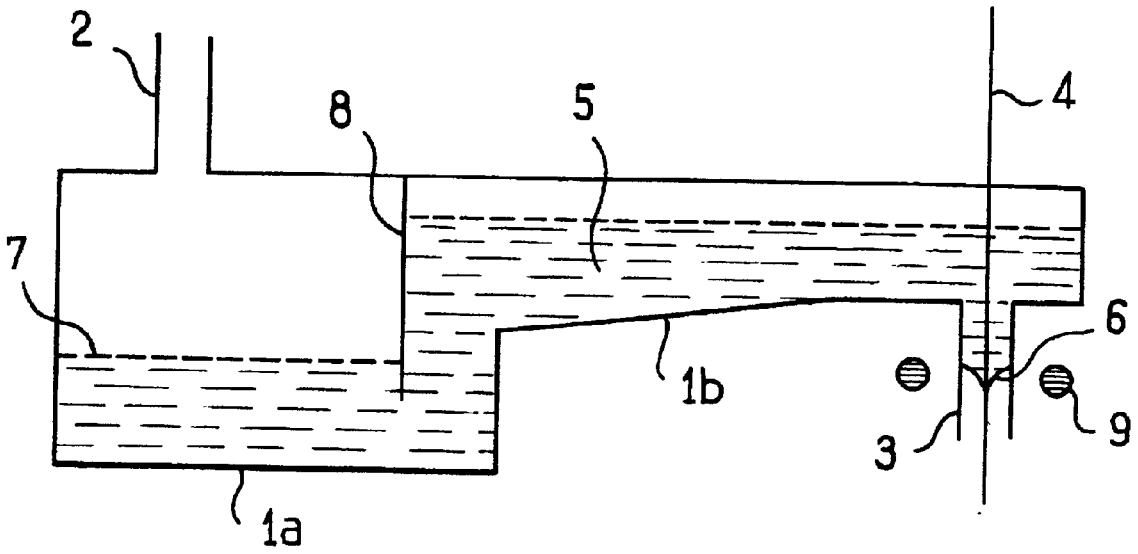
FIG. 4 is a simplified sectional view identical to that in FIG. 1, but with an exit channel directed vertically downwards.

Finally, FIG. 4 shows a device similar to that in FIG. 1, but with an exit channel 3 constructed on the lower face of compartment 1*b*. In this case the direction of travel of metal wire 4 is from top to bottom.

It has been demonstrated that the formulae obtained for determining the thickness of the coating can be used in configurations with vertical drainage towards the top or towards the bottom, horizontal drainage and slanting drainage.

The invention described above thus permits very precise and efficient control, with a low power requirement and also a small temperature rise, of the thickness of a metallic coating on an object whose diameter (or thickness) can be very small. The object coated can be, but is not restricted to, a plate, a circular or non-circular wire, or a round, oval or square tube.

Of course, the invention is not limited to the examples that have just been described, and numerous adaptations can be made to these examples while remaining within the scope of the invention.

What is claimed is:

1. A method of producing a metallic coating on an object emerging from a bath of molten metal, in which a magnetic field is created near the exit point of the object, wherein the object leaves the bath of molten metal via an exit channel containing a meniscus of the bath of molten metal, and a thickness $e_o$ of the metallic coating is controlled as a function of a second derivative $\Phi$ of the curve of the meniscus and a capillary number Ca representing the ratio between the viscous forces of the molten metal and the forces of surface tension at the surface of the molten metal, said function being $e_o\Phi_{zz}=1.3\ C_a^{2/3}$, z being the axis of travel.

2. A method according to claim 1, wherein during vertical drainage upwards, the exit channel is dimensioned in such a way as to maintain the meniscus of the molten metal in conditions close to capillary-gravitational equilibrium in the magnetic field, and wherein the second derivative of the curve of the meniscus is a function of an electromagnetic forming parameter K representing the ratio between the forces of surface tension and the forces due to the effect of electromagnetic forming.

3. A method according to claim 1, wherein the exit channel is constructed in such a way that an annular gap is of the same order as the height of the meniscus, the annular gap being the distance between the inside wall of the exit channel and the metallic coating formed beyond the meniscus.

4. A method according to claim 1, wherein during the vertical drainage downwards in the case of a wire, the second derivative of the curve of the meniscus is a function:

of the ratio between the average thickness of the wire and the opening of the exit channel; and of the ratio between the Alfen rate $U_A$ and the rate of drainage of the wire, this function being:

$$\varphi_{zz} = \frac{1}{R1}\left[2 + \left(\frac{R1}{RO}\right)^4 \cdot \left(1 + \frac{U_A^2}{\alpha V_0^2}\right)\right]$$

where R1 is the radius of the wire, R0 is the radius of the opening of the exit channel, $V_o$ is the velocity of travel of the wire, and $\alpha$ is a term reflecting the influence of the Couette flow, equal to:

$$\frac{1}{2}\left[\frac{1-\left(\frac{R1}{R0}\right)^2}{1n\frac{1}{\left(\frac{R1}{R0}\right)}} - 2\left(\frac{R1}{R0}\right)^2\right].$$

5. A method according to claim 1, wherein the exit channel is constructed so that the radio between the average thickness of the object and the opening of the exit channel as greater than or equal to 0.8.

6. A method according to claim 1, wherein the magnetic field is alternating and steady-state, and is created by means of a flat inductor.

7. A method according to claim 1, wherein the magnetic field is created by means of an alternating current whose frequency is such that the ratio between the capillary length and the thickness of the magnetic skin in the metallic coating is greater than or equal to 3.

8. A method according to claim 1, for horizontal drainage with an exit channel containing a meniscus obtained by applying a sliding field in the bath of molten metal, wherein the second derivative of the curve of the meniscus is a function of a Bond number Bd representing the ratio between the forces of gravity and the forces of surface tension.

9. A method according to claim 1, wherein means of exerting pressure on the molten metal are used for maintaining the height of the meniscus in the exit channel.

10. A method according to claim 1, wherein means of electromagnetic pumping of the molten metal are used for maintaining the height of the meniscus in the exit channel.

11. A method according to claim 1, wherein the object is a long and slender object with constant cross-section.

* * * * *